US007849524B1

(12) United States Patent
Williamson et al.

(10) Patent No.: US 7,849,524 B1
(45) Date of Patent: Dec. 14, 2010

(54) APPARATUS AND METHOD FOR CONTROLLING TEMPERATURE WITH A MULTIMODE HEAT PIPE ELEMENT

(75) Inventors: Weldon S. Williamson, Malibu, CA (US); Andrew C. Chu, Cambridge, MA (US); Thomas B. Stanford, Jr., Oxnard, CA (US); Elena Sherman, Culver City, CA (US)

(73) Assignee: Raytheon Company, Waltham, MA (US)

( * ) Notice: Subject to any disclaimer, the term of this patent is extended or adjusted under 35 U.S.C. 154(b) by 995 days.

(21) Appl. No.: 11/538,610

(22) Filed: Oct. 4, 2006

(51) Int. Cl.
*A42B 1/06* (2006.01)

(52) U.S. Cl. ..... 2/410

(58) Field of Classification Search ..... 2/410, 2/411, 413, 171, 171.2, DIG. 5, DIG. 1, 458, 2/2.11, 7, 8.1; 62/259.3, 457.2, 457.9, 530
See application file for complete search history.

(56) References Cited

U.S. PATENT DOCUMENTS 4,133,055 A 1/1979 Zebuhr ..... 2/411
4,551,858 A 11/1985 Pasternack ..... 2/7
4,555,816 A * 12/1985 Broersma ..... 2/425
5,345,614 A * 9/1994 Tanaka ..... 2/425
2004/0255364 A1* 12/2004 Feher ..... 2/171.3

FOREIGN PATENT DOCUMENTS

JP 2005042261 * 2/2005

* cited by examiner

*Primary Examiner*—Gary L Welch
*Assistant Examiner*—Amber R Anderson
(74) *Attorney, Agent, or Firm*—Baker Botts L.L.P.

(57) ABSTRACT

A helmet has an outer shell, an inner lining configured for thermal communication with a wearer's head, an intermediary layer disposed between the outer shell and the inner lining with a layer of insulating material with a plurality of passageways therein and a cavity defined by the outer shell and the outer surface of the intermediary layer, and a fluid contained between the outer shell and the inner lining. In another variation, the insulating material includes a shape memory polymer operable to change the size of one or more of the plurality of passageways when activated. In yet another variation, the helmet has one or more selectively closeable pores in its outer shell and may have a fixed or detachable fluid reservoir.

13 Claims, 2 Drawing Sheets

APPARATUS AND METHOD FOR CONTROLLING TEMPERATURE WITH A MULTIMODE HEAT PIPE ELEMENT

TECHNICAL FIELD OF THE INVENTION

This invention relates in general to cooling techniques and, more particularly, to cooling techniques which facilitate control of temperatures of a wearer of a protective helmet.

BACKGROUND OF THE INVENTION

There are a variety of types of applications in which there is a need to control temperatures and/or temperature gradients. One example is that of a person who may need to wear a protective helmet, such as a military or police helmet, a construction helmet, a firefighting helmet, a sports helmet, a motorcycle or other vehicular helmet, or a helmet for any other activity requiring protection for the wearer's head. In some instances, the wearer may be engaged in an activity wherein a significant amount of heat is generated, e.g., running, carrying heavy loads, or participating in a sporting event, and physical duress due to heat may be an issue. A significant amount of generated heat may be given off by a wearer's head, and a helmet having cooling properties may be desirable to increase the amount of heat transferred away from the wearer.

OVERVIEW OF EXAMPLE EMBODIMENTS

A first form of the invention involves a helmet with a controllable heat exchange fluid in a closed heat exchange loop. The heat exchange fluid may travel through the loop, absorbing heat from the wearer and transferring it away from the helmet. The wearer may be able to control the degree to which the fluid is allowed to travel through the loop, or whether the fluid travels at all. Such a helmet may further comprise an active material that may adjust the insulative properties thereof.

A second form of the invention involves a helmet with a controllable heat exchange fluid in an open heat exchange loop. The heat exchange fluid may travel through the loop, absorbing heat from the wearer and transferring it to the environment. As the fluid loop may be open to an environment surrounding the helmet, some or all of the heat exchange fluid may exit the helmet. In some circumstances, additional heat exchange fluid may be added to the helmet. The wearer may be able to control the degree to which the fluid is allowed to travel within the loop, the degree to which it may travel outside the loop, or whether the fluid travels at all.

A technical advantage of an embodiment of the present invention is that a helmet may be configured to adjust its insulative properties to provide a varying degree of insulating or cooling of a wearer's head based upon the environmental factors and activity level of the wearer. Another technical advantage of an embodiment of the present invention is that the heating or cooling function may be configured to operate without intervention from the wearer. Yet another technical advantage of an embodiment of the present invention is the ability to quickly change the heat exchange properties of a helmet by introducing, modifying or removing a heat exchange fluid from the heat exchange circuit. Still another technical advantage of an embodiment of the present invention is the ability to provide a cooling function to the helmet when ambient conditions do not allow a closed-circuit heat pipe to cool effectively, such as in a high heat, high humidity environment. While specific advantages have been enumerated above, various embodiments may include all, some, or none of the enumerated advantages.

Other technical advantages of the present invention will be readily apparent to one skilled in the art from the following figures, descriptions, and claims.

BRIEF DESCRIPTION OF THE DRAWINGS

A better understanding of the present invention will be realized from the detailed description which follows, taken in conjunction with the accompanying drawings, in which.

DETAILED DESCRIPTION OF EXEMPLARY EMBODIMENTS

Figure 1:
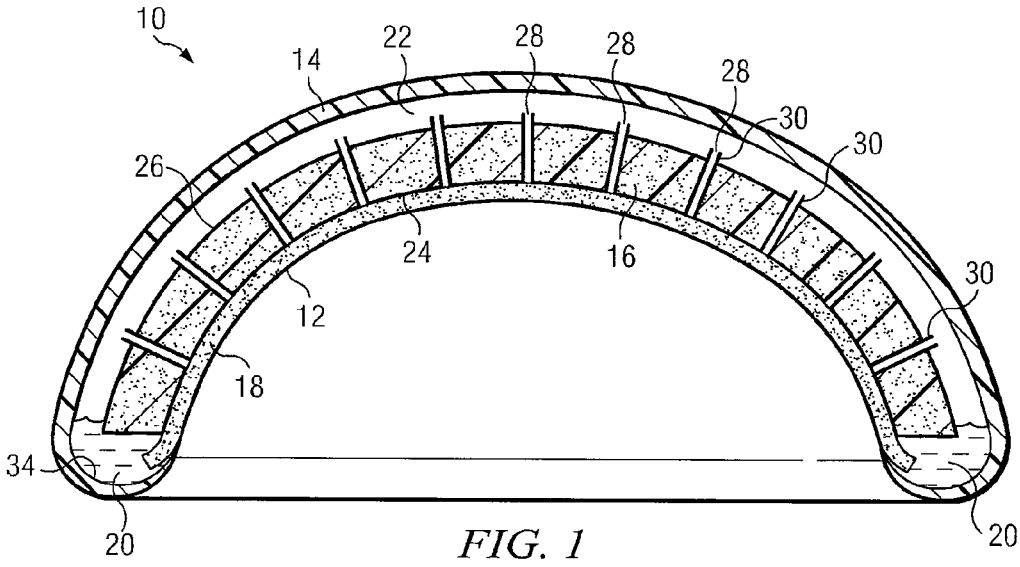
FIG. 1 depicts a cross-sectional view of one embodiment of a helmet incorporating a heat exchange fluid circuit.

Referring to FIG. 1, a first embodiment of helmet includes an inner lining 12, an outer shell 14, an intermediary layer 16, and a wick 18.

Inner lining 12 may be designed for thermal communication with the wearer's head. In one embodiment, inner lining 12 may be made from either a naturally occurring or man-made flexible material, e.g., a vinyl liner. In another embodiment, inner lining 12 may be formed from a more rigid material, e.g., a molded plastic or other suitable material.

Shell 14 may be any material suited to the helmet's intended use. Shell 14 may include plastic or metal materials, or may include one or more composite materials. For military or police implementations, shell 14 may have anti-ballistic capabilities and may include materials such as Kevlar® fibers or layers, or other composite materials suited to such a purpose. Fins (not shown) may also be incorporated within the design of shell 14, or attached thereto, to increase the heat dissipation or aerodynamic cooling of shell 14.

Shell 14 (or fins incorporated in or affixed thereto) may also comprise one or more coatings. In one exemplary embodiment, a coating may be applied comprising a material that has a high spectral emissivity in the infrared and a low total absorptivity for the spectrum of light in which the helmet is designed to operate. In one such exemplary embodiment, a coating that reflects sunlight and radiates infrared (e.g, aluminized Kapton) may be incorporated in shell 14 to provide a high-visibility helmet when desired (e.g, for application in firefighting, construction workers, mountain climbers). In another exemplary embodiment, a coating may be applied to shell 14 to reduce optical visibility (e.g., for military applications). In yet another exemplary embodiment, a coating may be applied to shell 14 that reduces visibility in the visible spectrum while increasing visibility in another electromagnetic spectra (e.g., reflective within a range of the microwave spectrum).

Intermediary layer 16 has an inner surface 24 and an outer surface 26, and a plurality of passageways 28 extending therebetween. The plurality of passageways 28 may extend slightly beyond the outer surface 26, forming one or more condensation dams 30. Although all of the passageways 28 are depicted as being co-planar in the cross section of helmet 10 shown in FIG. 1, passageways 28 will be distributed throughout the intermediary layer 16 in an appropriate fashion depending upon the intended use and design parameters of the heat-pipe element.

Intermediary layer 16 may include any material exhibiting desirable insulative properties. In one embodiment, intermediary layer 16 may include a foam material, e.g., polystyrene foam (e.g., Styrofoam), polymethacrylimide foam (e.g., Rohacell), or metal foam. In another embodiment, layer 16 may include an actuated material, such as a shape memory polymer (SMP) or shape memory alloy (SMA). In yet another embodiment, intermediary layer 16 may include a thin-walled metal shell. In one embodiment, the thin-walled metal shell may contain a gas. In another embodiment, the thin-walled shell may be evacuated to exhibit properties similar to those in a vacuum-canister, e.g., a "Thermos-type" container. Intermediary layer 16 also may be coated with a hydrophobic material.

Wick 18 may be made of any material suitable for absorbing heat exchange fluid 20. In one embodiment, wick 18 includes a fibrous material. In another embodiment, wick 18 includes an open-cell foam. In one example embodiment of helmet 10, wick 18 includes an open-cell foam with sufficiently small pores to permit the working fluid to be wicked to the top of the helmet. In yet another example embodiment of helmet 10, wick 18 is incorporated within a support structure (not shown) that holds or maintains helmet 10 about the wearer's head (e.g., the webbing of a military helmet).

Heat exchange fluid 20 may be any suitable fluid, e.g., a fluid with appropriate phase change properties or appropriate thermal properties. In one embodiment, fluid may include some form of alcohol, such as a high molecular weight alcohol, e.g., ethanol. In another embodiment, fluid 20 may include water. In still another embodiment, fluid 20 may include glycol. In yet another embodiment, fluid 20 may include one or more freons. In still another embodiment, fluid 20 may include one or more fluorinerts.

Figure 2:
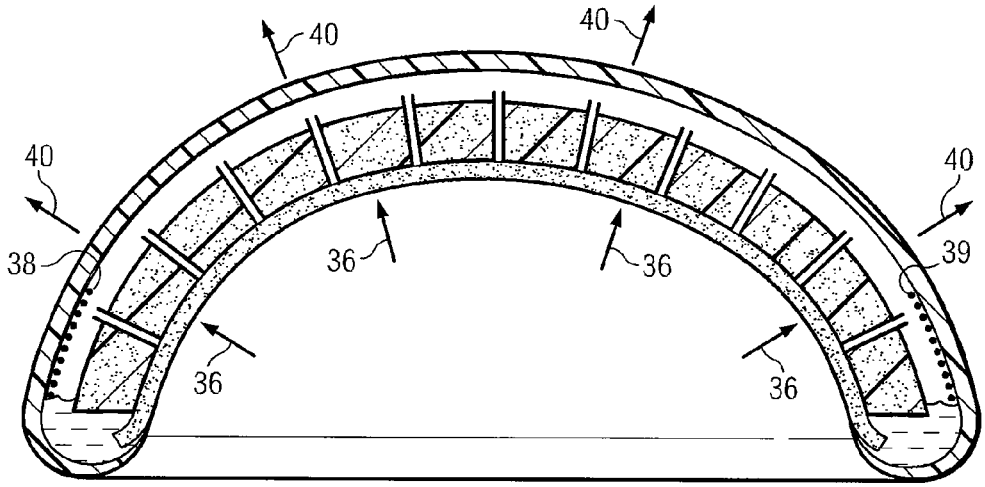
FIG. 2 depicts details of a heat exchange fluid circuit incorporated in one embodiment of the present invention.

Referring now to FIGS. 1 and 2, an embodiment of helmet 10 is depicted, along with details regarding the operation of the heat exchange circuit. Heat exchange fluid 20 may originate in a lower portion of cavity 22 that forms fluid well 34, into which wick 18 may extend. Either a portion or all of fluid 20 may be absorbed into wick 18. Body heat from the wearer's head, indicated by arrows 36 may pass through inner lining 12 and may be absorbed by fluid 20. Heat absorption into fluid 20 may cause fluid 20 to undergo either a partial or total phase change from a liquid phase to a gaseous phase. The gaseous and/or heated liquid portions of fluid 20 may flow through the plurality of passageways 28.

Upon contact with the shell 14 or outer surface 26 of intermediary layer 16, some or all of the gaseous portion of fluid 40 may condense into a liquid phase. Some fluid may also condense on the outer surface 26 of intermediary layer 16. Heat is transferred away from shell 14 as depicted by arrows 40. Whether or not condensation dams 30 are present, some or all of fluid 20 may be prevented from traveling back through the passageways 28. However, if condensation dams 30 are present, a greater amount of fluid 20 may be prevented from traveling through passageways 28. Thus, some or all of condensed portion of fluid 20 may return to fluid well 34, e.g., via condensation paths 38 and 39. In one embodiment, intermediary layer 16 may be coated with a hydrophobic coating to enhance the movement to fluid 20 toward fluid well 34.

Thus, according to the above-described embodiment of the invention, a helmet 10 is provided that may lessen the need to remove and replace the helmet from the wearer's head due to varying environmental conditions or activity levels of the wearer. In addition, the closed heat exchange circuit may require less maintenance or less frequent refilling of the heat exchange fluid 20.

Figure 3:
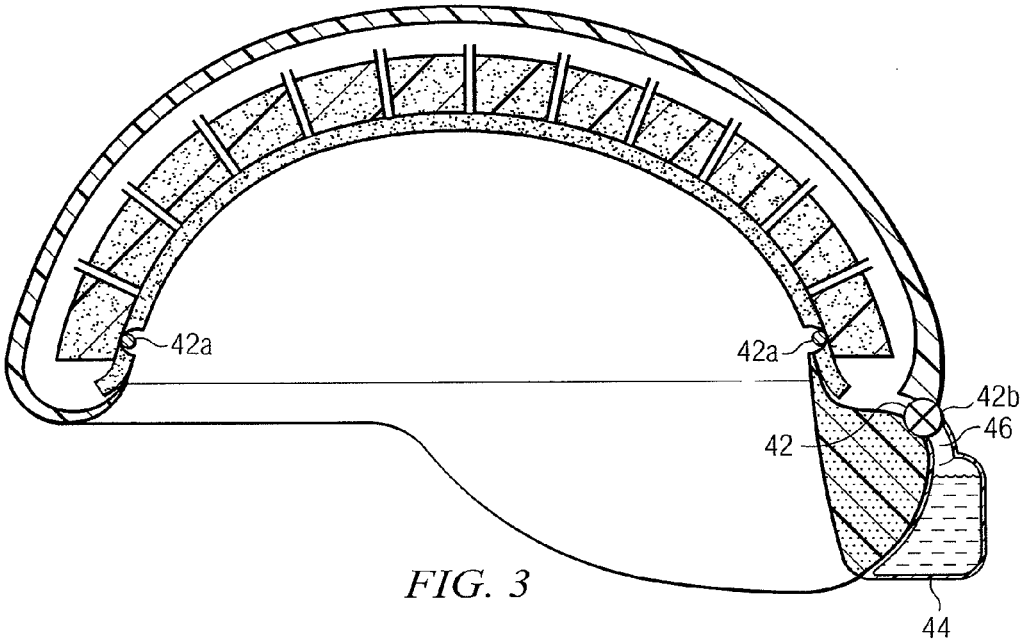
FIG. 3 depicts a cross-sectional view depicting another embodiment of the present invention that incorporates one or more restrictors to adjust the operation of the heat exchange fluid circuit.

In another embodiment of the present invention, as depicted in FIG. 3, fluid 20 may be stored in a reservoir 44 that is in fluid communication with cavity and may be introduced into cavity 22 when desired. While reservoir 44 is depicted in FIG. 3 as disposed in the outside rear portion of the helmet, reservoir 44 may be located in any desired position on the interior or exterior of the helmet that allows it to be in fluid communication with the cavity. In one embodiment incorporating reservoir 44, reservoir 44 may be detachable from helmet 10. In another embodiment, reservoir 44 is not detachable from helmet 10. In yet another embodiment, reservoir 44 includes a flexible material that facilitates introduction of the heat exchange fluid into cavity 22 by squeezing or compressing reservoir 44. Such squeezing may be performed manually or using an apparatus to facilitate the compression.

Referring again to FIGS. 1-3, one or more restrictors 42 may be engaged to reduce, or substantially eliminate, the ability of heat exchange fluid 20 to interact with wick 18. In one such embodiment, the restrictor may include a clamp ring 42*a* disposed about the circumference of the helmet, e.g., an expanding over-center clamp ring. In one such embodiment, clamp ring 42*a* may be engaged to compress wick 18 between liner 12 and intermediary layer 16, restricting the absorption of fluid 20 into wick 18. In FIG. 3, clamp ring 42*a* is depicted in an expanded state, wherein wick 18 is compressed, as described above.

Although FIG. 3 depicts a helmet 10 with a rear portion that extends downward behind the wearer's neck, any suitably-shaped helmet may include one or more restrictors. For example, helmet 10 depicted in FIGS. 1-2 may utilize one or more restrictors, e.g., clamp ring 42*a* or valve 42*b*, to reduce the flow of fluid 20 through the heat exchange circuit. In an embodiment of helmet 10 that incorporates reservoir 44 for fluid storage as described above, restrictor 42 may include a valve 42*b* disposed within fluid passageway 46 and operable to connect or disconnect reservoir 44 from cavity 22. In yet another embodiment, restrictor 42 may be a clamping device (not shown) that compresses fluid passageway 46. By opening or disengaging restrictor 42, fluid 20 may be allowed to flow into cavity 22 and begin the heat exchange cycle. Once all or a portion of fluid 20 is released from reservoir 44, restrictor 42 may be re-engaged to help prevent fluid 20 from re-entering reservoir 44. Restrictor 42 may again be disengaged to allow fluid 20 to flow back into reservoir 44.

When restrictor 42 is operated to cause fluid 20 to be contained within cavity 22, the heat exchange cycle may occur. Under a similar process as described in reference to FIG. 2, any portion of heat exchange fluid 20 that may be present in wick 18 may evaporate and re-condense until it returns to well 34. At that point, fluid 20 may be restricted from continuing through any additional heat exchange cycles or fluid 20 may be allowed to continue through heat exchange cycles, as desired. For example, if the wearer desires the cooling properties of the heat exchange circuit, clamp ring 42*a* may be released. In another example embodiment wherein the wearer desires the cooling properties of the heat exchange circuit, fluid 20 may be introduced into cavity 22 from reservoir 44.

A wearer may operate restrictor 42 to reduce or eliminate the movement of the heat exchange fluid 20, thereby reducing the cooling effect. For example, if the amount of heat produced by the wearer decreases or if the wearer enters a cooler environment, a reduction in the rate of heat exchange may be desired. Under some circumstances, it may be desirable to substantially eliminate the heat exchange fluid 20 from interaction with the wick 18, which may increase the insulative properties of the helmet. In one embodiment, this may be accomplished by engaging clamp ring 42*a*. In another embodiment, valve 42*b* may be opened to allow fluid 20 to collect in reservoir 44.

Other methods of stopping the heat exchange cycle may be utilized, as well. For example, one may select fluid 20 having properties that induce an automatic slowing or stopping of the heat exchange cycle. For example, depending upon the environment in which helmet 10 is used, fluid 20 may be chosen having a freezing temperature below that of the ambient temperature around shell 14. In such circumstances, fluid 20 may change from a liquid or gaseous phase to a solid phase upon contact with shell 14 rather than returning to well 34, thus interrupting the heat exchange cycle until the temperature of shell 14 increases above the freezing temperature of fluid 20.

Thus, according to the above-described embodiment of the invention, a helmet 10 is provided that may be quickly adapted by the wearer to provide an appropriate level of cooling or insulation depending upon current operating conditions, e.g., temperature of the environment, physical activity of the wearer.

Figure 4:
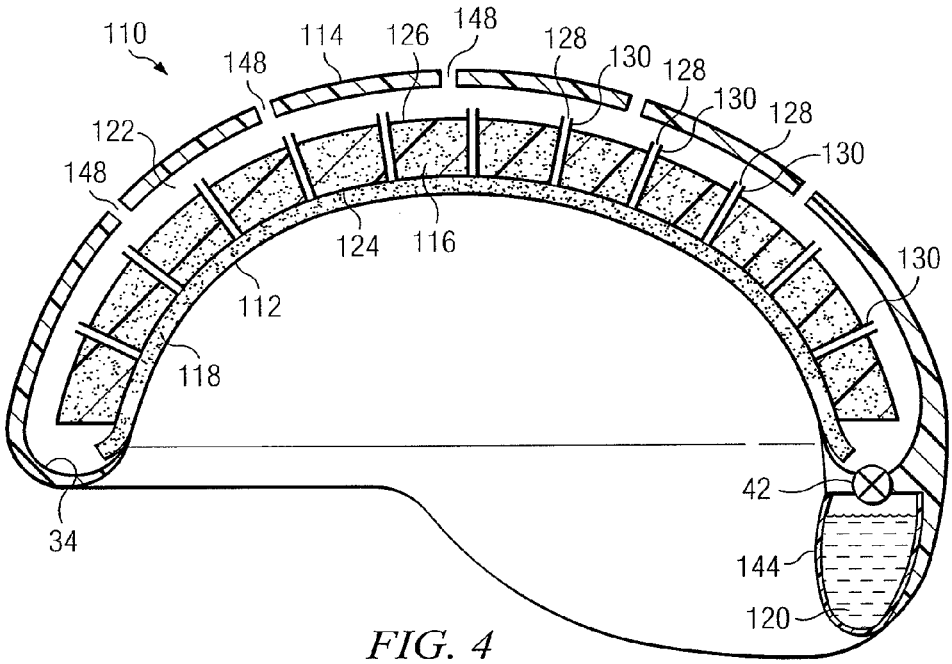
FIG. 4 depicts a cross-sectional view of yet another embodiment of a helmet incorporating a heat exchange fluid circuit that may be open to an environment outside the helmet.

Referring to FIG. 4, yet another embodiment of the present invention is depicted that incorporates a heat transfer circuit that is open to an environment outside the helmet. Helmet 110 includes an inner lining 112, an outer shell 114, an intermediary layer 116, and a wick 118.

Intermediary layer 116 has an inner surface 124 and an outer surface 126, and a plurality of passageways 128 extending therebetween. The plurality of passageways 128 may extend slightly beyond the outer surface 126, forming one or more condensation dams 130. Intermediary layer 116 may be coated with a hydrophobic material.

In one embodiment, shell 114 has a plurality of pores 148 that vent heat exchange fluid 120 out of cavity 122 of helmet 110. Pores 148 may be either fixed or variable in size. In one embodiment, pores 148 may be configured to be opened or closed under certain conditions, e.g., environmental conditions in which helmet 110 is being used, or the desires of the wearer. In another embodiment, pores 148 remain open. Although pores 148 are depicted as being co-planar in FIG. 4, any suitable arrangement of pores 148 may be present in shell 114. Pores 148 may permit free evaporation which may allow the helmet to cool under conditions in which the heat-pipe action is inactive. Such conditions may occur when the temperature of the outer shell 14 of helmet 10, as shown in the exemplary embodiment depicted in FIG. 1, is too high for condensation of the working fluid to occur. Moreover, automatic control of the release of the working fluid via pores 148 may help minimize the weight of fluid the wearer may be required to carry during use of helmet 110.

In still another embodiment, a heat exchange fluid reservoir 144 may be in fluid communication with cavity 122. Although fluid reservoir 144 is depicted in FIG. 4 as being disposed on the rear interior surface of the helmet, it could be disposed at any suitable location on or in the helmet. Reservoir 144 may be detachable from helmet 110 or fixed in place on helmet 110. In an embodiment incorporating reservoir 144, reservoir 144 may be detachable from helmet 110, or reservoir 144 may be fixed in place on helmet 110. In one such embodiment, reservoir 144 includes a flexible material that facilitates introduction of the heat exchange fluid into cavity 122 by squeezing or compressing reservoir 144.

In yet another embodiment, fluid 120 may be added to the heat exchange circuit, e.g., by refilling or replacing reservoir 144. In an embodiment utilizing a removable or replaceable reservoir 144, different fluids may be utilized as heat exchange fluid 120 within the helmet at different times. For example, fluid 120 may be selectively modified or replaced depending upon certain factors, e.g, differing operating environments, relative availability of various heat exchange fluids, or the anticipated activity of the wearer.

As alternative embodiments, any of the above-described embodiments of the present invention may utilize an intermediary layer including one or more active materials, e.g., shape memory polymer (SMP), SMP foam, shape memory alloy (SMA), SMA foam, or hydrogels. Furthermore, in some embodiments incorporating such active materials, the active material may act as both intermediary layer 16 and wick 18 (or intermediary layer 116 and wick 118, in one such alternative embodiment).

In an embodiment using an active material, the heat exchange circuit may be affected by changing material properties, e.g., pore size, fluid permeability, or gas diffusivity, through any one or more of a variety of known methods or triggers. Such methods or triggers may include, but are not limited to, use of applied electric potentials, ambient temperature, chemical reactions, and the like.

In an embodiment using an applied electric potential, the active material may be activated by a circuit comprising a power source, e.g., a battery, in electrical communication with the active material. In one such embodiment, automatic regulation of the active material may be maintained by a suitable circuit comprising temperature sensors and a thermostat. In another embodiment, the active material may be activated manually, e.g., by a switch. In yet another embodiment, the voltage applied to the active material may be varied by a suitable component, e.g., using a potentiometer, rheostat, or thermistor.

Although selected embodiments have been illustrated and described in detail, it will be understood that various substitutions and alterations are possible without departing from the spirit and scope of the present invention, as defined by the following claims.

What is claimed is:

1. A helmet comprising:

an outer shell;

an inner lining configured for thermal communication with a wearer's head;

an intermediary layer disposed between the outer shell and the inner lining and comprising a layer of insulating material with a plurality of passageways extending in a substantially radial direction from an inner surface of the layer of insulating material to an outer surface of the layer of insulating material;

a cavity defined by the outer shell and the outer surface of the intermediary layer and operable to collect condensation;

a liquid reservoir comprising a heat exchange liquid; and a wicking material layer disposed between the layer of insulating material and the inner lining, the wicking material layer extending into the liquid reservoir and operable to absorb at least some of the heat exchange liquid.

2. A helmet comprising:

an outer shell;

an intermediary layer comprising an layer of insulating material, the layer of insulating material comprising an inner surface and an outer surface with a plurality of passageways between the inner surface and the outer surface, the intermediary layer being separated from the outer shell by a cavity operable to collect condensation;

an inner lining disposed inwardly from the intermediary layer;

a liquid reservoir comprising a heat exchange liquid; and a wicking material layer disposed between the intermediary layer and the inner lining, the wicking material layer extending into the liquid reservoir and operable to absorb at least some of the heat exchange liquid.

3. The helmet of claim 2 wherein the layer of insulating material comprises a hollow metal shell.

4. The helmet of claim 3 wherein the hollow metal shell contains a gas.

5. The helmet of claim 3 wherein the hollow metal shell is formed with essentially a vacuum therein.

6. The helmet of claim 2 further comprising:

a plurality of pores within the outer shell and operatively coupling the cavity with an environment outside the helmet.

7. The helmet of claim 6 wherein the plurality of pores comprise one or more selectively closeable pores.

8. The helmet of claim 2 wherein the liquid reservoir is disposed in a rear portion of the helmet.

9. A helmet comprising:

an outer shell;

an intermediary layer comprising a layer of insulating material, the layer of insulating material comprising an inner surface and an outer surface with a plurality of passageways between the inner surface and the outer surface, the intermediary layer being separated from the outer shell by a cavity operable to collect condensation;

an inner lining;

a liquid reservoir comprising a heat exchange liquid; and a wicking material layer disposed between the intermediary layer and the inner lining, the wicking material layer extending into the liquid reservoir and operable to absorb at least some of the heat exchange liquid;

wherein the insulating material comprises a shape memory polymer operable to change the size of one or more of the plurality of passageways when activated.

10. The helmet of claim 9 wherein the shape memory polymer is operable to be activated by a temperature change.

11. The helmet of claim 9 wherein the shape memory polymer is operable to be activated by an applied electrical potential.

12. The helmet of claim 9 wherein the shape memory polymer is operable to be activated by the presence of a chemical agent.

13. A helmet comprising:

an outer shell;

an intermediary layer comprising a layer of active material, the layer of active material comprising an inner surface and an outer surface with a plurality of passageways between the inner surface and the outer surface, the intermediary layer being separated from the outer shell by a cavity operable to collect condensation;

a liquid reservoir comprising a heat exchange liquid; and an inner lining;

wherein the active material comprises a shape memory polymer operable to change the size of one or more of the plurality of passageways when activated.

* * * * *